US005234075A

United States Patent [19]

Lowden

[11] Patent Number: 5,234,075

[45] Date of Patent: Aug. 10, 1993

[54] FIRE ESCAPE APPARATUS

[76] Inventor: Ralph L. Lowden, Box 36, Gaastra, Mich. 49927

[21] Appl. No.: 797,416

[22] Filed: Nov. 21, 1991

[51] Int. Cl.[5] ..... A63B 27/00

[52] U.S. Cl. ..... 182/135; 182/193; 182/5

[58] Field of Search ..... 182/135, 136, 133, 134, 182/5-7, 9, 72, 193

[56] References Cited

U.S. PATENT DOCUMENTS

| | | | |
|---|---|---|---|
| 315,025 | 4/1885 | Heath | 182/135 |
| 3,658,151 | 4/1972 | Wisdom | 182/135 |
| 3,677,367 | 7/1972 | Shotmeyer | 182/136 |
| 4,276,958 | 7/1981 | Skaalen | 182/135 |
| 4,301,891 | 11/1981 | Harbian | 182/135 |
| 5,029,669 | 7/1991 | Lew et al. | 182/5 X |

FOREIGN PATENT DOCUMENTS

| | | | |
|---|---|---|---|
| 19838 | 11/1904 | Austria | 182/5 |
| 0641052 | 2/1984 | Switzerland | 182/72 |

*Primary Examiner*—Karen J. Chotkowski
*Attorney, Agent, or Firm*—Leon Gilden

[57] ABSTRACT

A central conduit includes a plurality of spaced first and second support housings mounted to the conduit, with the first and second housings pivotally mounting a respective first and second brake rod. Each brake rod including a brake pad surface for projection through a first and second slot for communication with a rope through the conduit to slow descent by an individual utilizing the apparatus to descend a rope member. A modification of the invention includes a seat member mounted to the conduit, as well as a further assembly positioned below to include further brake rods for use by an individual's feet in controlling descent downwardly along a rope member.

2 Claims, 5 Drawing Sheets 10
11
12
13
14
15
16
17
18
19
20
21
22

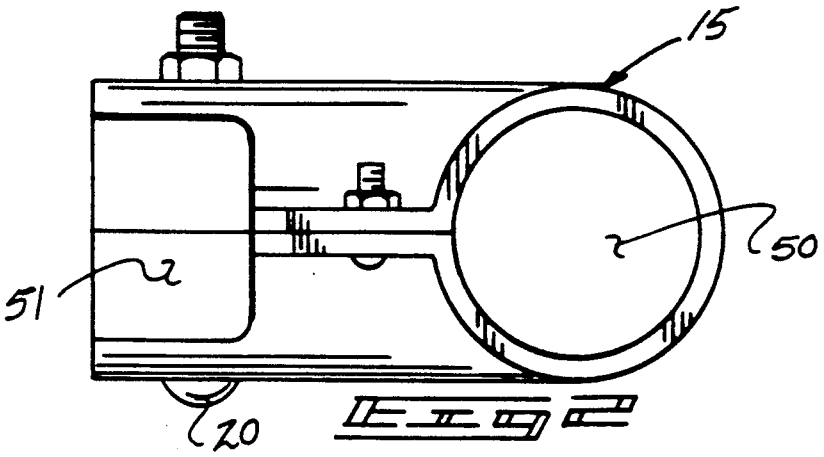
Fig 2
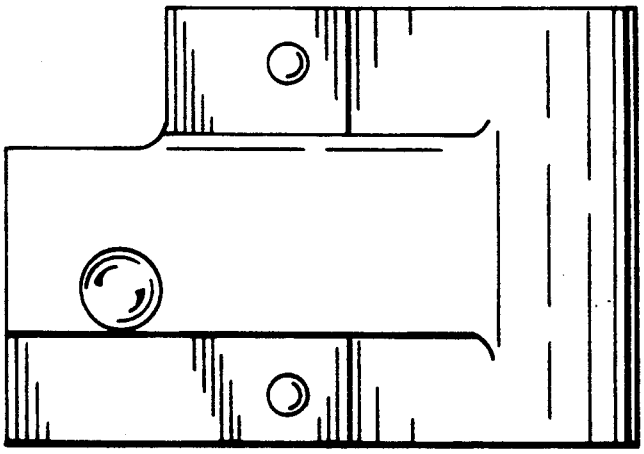
Fig 3
Fig 4
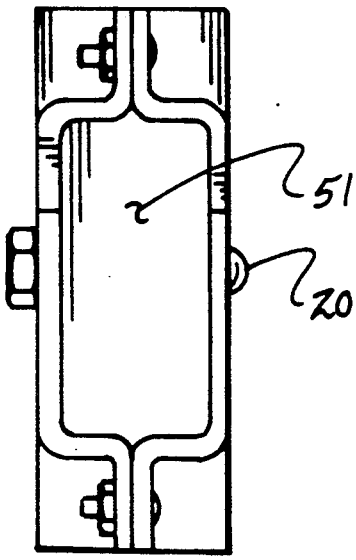

FIRE ESCAPE APPARATUS

BACKGROUND OF THE INVENTION

1. Field of the Invention

The field of invention relates to rope lowering devices, and more particularly pertains to a new and improved fire escape apparatus wherein the same is directed to arranging for a clamp structure to control descent along a rope.

2. Description of the Prior Art

Controlled descent downwardly along a flexible rope member requires skill, dexterity, and strength not available to all individuals without training and practice. The instant invention sets forth an organization permitting individuals to utilize a rope in descent from an elevated position to provide for a controlled descent along the rope. Prior art structure has been utilized to permit scaling and descaling of various structures and is exemplified in U.S. Pat. No. 1,831,068 to Hayslip wherein a carriage structure utilizes a central conduit to direct a rope therethrough, with the structure including a brake lever operative through a linkage arrangement to direct frictional engagement along a first side of a rope structure.

U.S. Pat. No. 4,407,391 to Greenway, et al. sets forth a pole climber's safety device to include a closed yoke for encompassing a pole to be climbed.

U.S. Pat. No. 286,644 to Seagrave sets forth a fire escape structure utilizing a multiple pulley system to permit descent of an individual from an elevated position.

As such, it may be appreciated that there continues to be a need for a new and improved fire escape apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of fire escape apparatus now present in the prior art, the present invention provides a fire escape apparatus wherein the same sets forth a tubular structure to permit descent in a controlled manner downwardly along a rope structure. As such, the general purpose of the present invention, which will be described subsequently in greater detail, is to provide a new and improved fire escape apparatus which has all the advantages of the prior art fire escape apparatus and none of the disadvantages.

To attain this, the present invention provides a central conduit including a plurality of spaced first and second support housings mounted to the conduit, with the first and second housings pivotally mounting a respective first and second brake rod. Each brake rod including a brake pad surface for projection through a first and second slot for communication with a rope through the conduit to slow descent by an individual utilizing the apparatus to descend a rope member. A modification of the invention includes a seat member mounted to the conduit, as well as a further assembly positioned below to include further brake rods for use by individuals' feet in controlling descent downwardly along a rope member.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved fire escape apparatus which has all the advantages of the prior art fire escape apparatus and none of the disadvantages.

It is another object of the present invention to provide a new and improved fire escape apparatus which may be easily and efficiently manufactured and marketed.

It is a further object of the present invention to provide a new and improved fire escape apparatus which is of a durable and reliable construction.

An even further object of the present invention is to provide a new and improved fire escape apparatus which is susceptible of a low cost of manufacture with regard to both materials and labor, and which accordingly is then susceptible of low prices of sale to the consuming public, thereby making such fire escape apparatus economically available to the buying public.

Still yet another object of the present invention is to provide a new and improved fire escape apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is an orthographic top view of a respective housing of the first and second housings utilized by the invention mounted to the conduit.

FIG. 3 is an orthographic frontal view of the housing.

FIG. 4 is an orthographic end view of the housing.

DESCRIPTION OF THE PREFERRED EMBODIMENT

Figure 1:
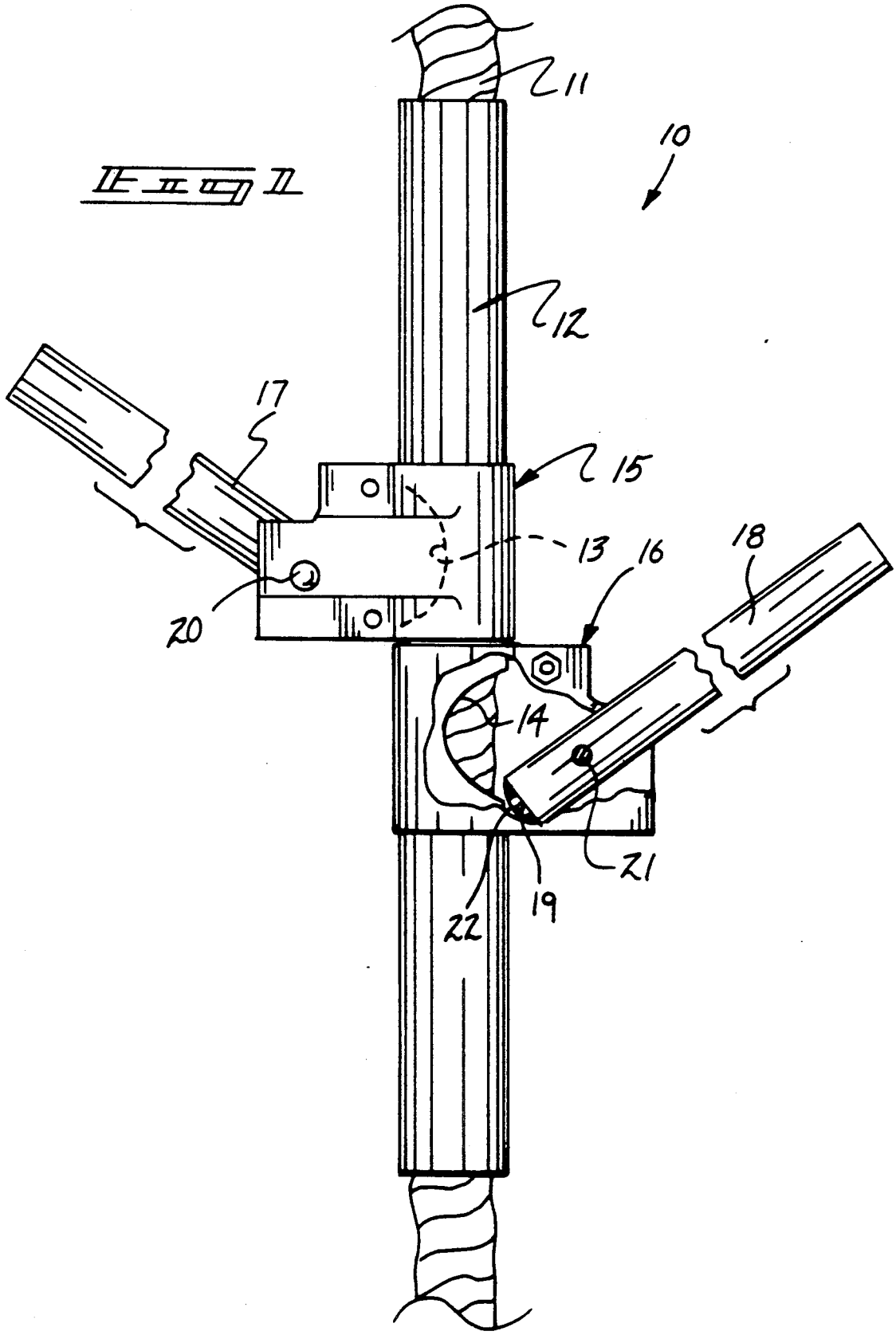
FIG. 1 is an isometric illustration of the instant invention.

With reference now to the drawings, and in particular to FIGS. 1 to 7 thereof, a new and improved Fire Escape Apparatus embodying the principles and concepts of the present invention and generally designated by the reference numeral 10 will be described.

Figure 7:
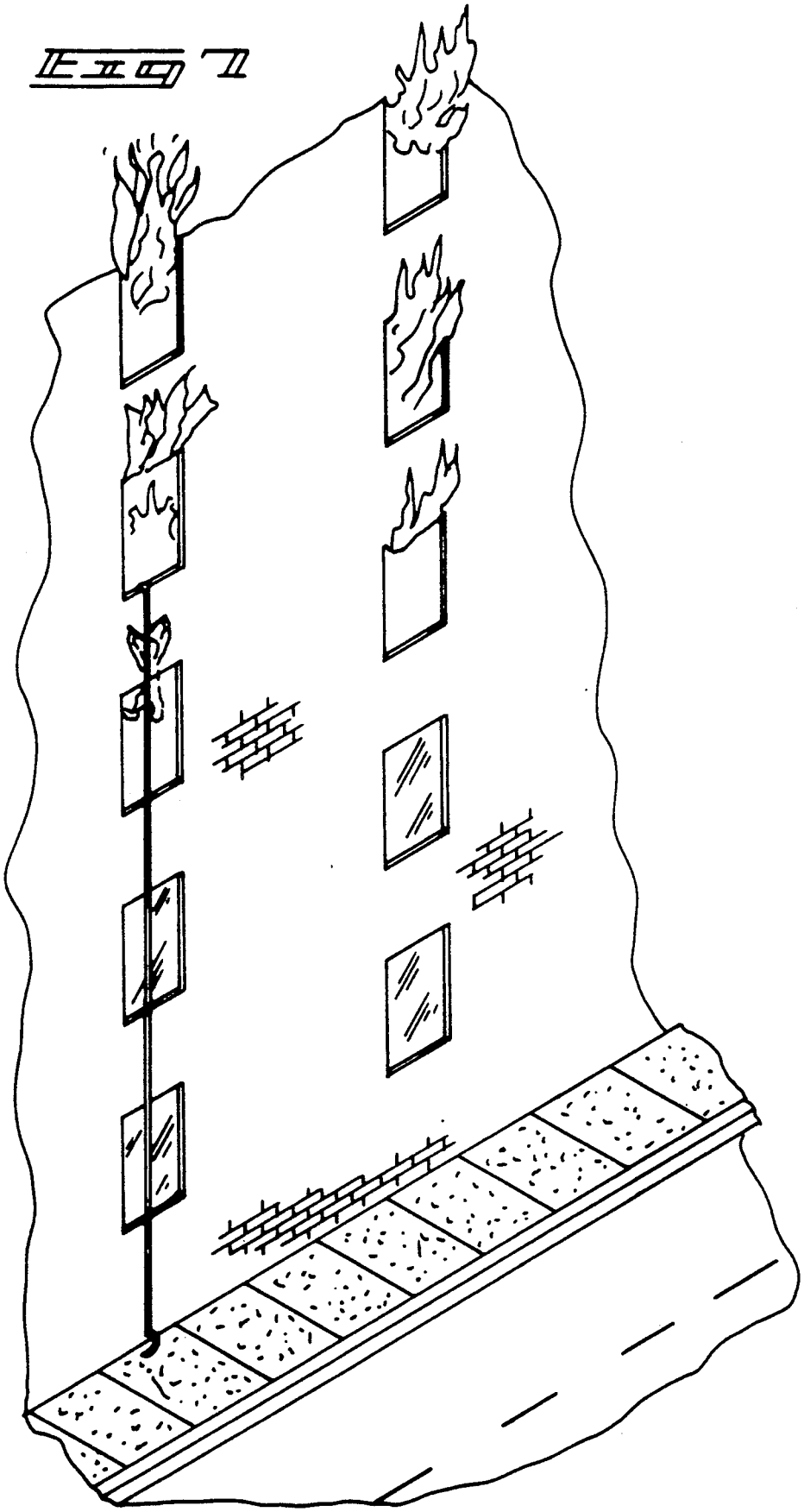
FIG. 7 is an isometric illustration of the invention in use.

More specifically, the fire escape apparatus 10 of the instant invention essentially comprises a flexible rope member 11 slidably directed through a rigid coaxially aligned conduit 12. A first and second housing 15 and 16 are fixedly mounted to diametrically opposed sides of the conduit 12 to position a respective first and second diametrically opposed conduit slot 13 and 14 directed through the conduit adjacent the first and second housings. A first brake rod 17 is pivotally mounted to the first housing by a first axle 20, wherein a second brake rod 18 is pivotally mounted to second housing by a second axle 21. The first and second axles are positioned in a spaced parallel relationship relative to each other and medially of the conduit slots in a spaced adjacency to the conduit slots. The first brake rod 17 and the second brake rod 18 each include a brake pad 19 fixedly mounted at a lower terminal end thereof, wherein each brake pad 19 is projected through a respective slot of the first and second conduit slots 13 and 14. The brake pads each include a semi-cylindrical convex engagement surface 22 projecting through each respective conduit slot for engagement with the rope 11. The housings 15 and 16 are in an axially spaced relationship relative to one another, wherein a lower distal end of the first housing 15 is in contiguous communication with an upper distal end of the second housing 16. The offset relationship of the first and second brake rods 17 and 18 respectively permits selective arresting of the rope 11 directed through the conduit 12, wherein an individual may thereby provide for a controlled descent along the rope 11, in a manner such as illustrated in FIG. 7. The FIGS. 2–4 illustrate a typical housing 15 where it is understood that the housings 15 and 16 are of identical construction, wherein a through-extending conduit receiving bore 50 is arranged for fixed securement to the conduit 12, wherein the associated rod channel 51 orthogonally intersects an axis defined by the conduit receiving bore 50 to permit access of the associated brake rod into an associated slot and engagement with the rope 11.

In this manner, an individual projecting the rods 17 and 18 downwardly enhance frictional engagement with the rope 11 and slow or arrest descent therealong as desired.

Figure 5:
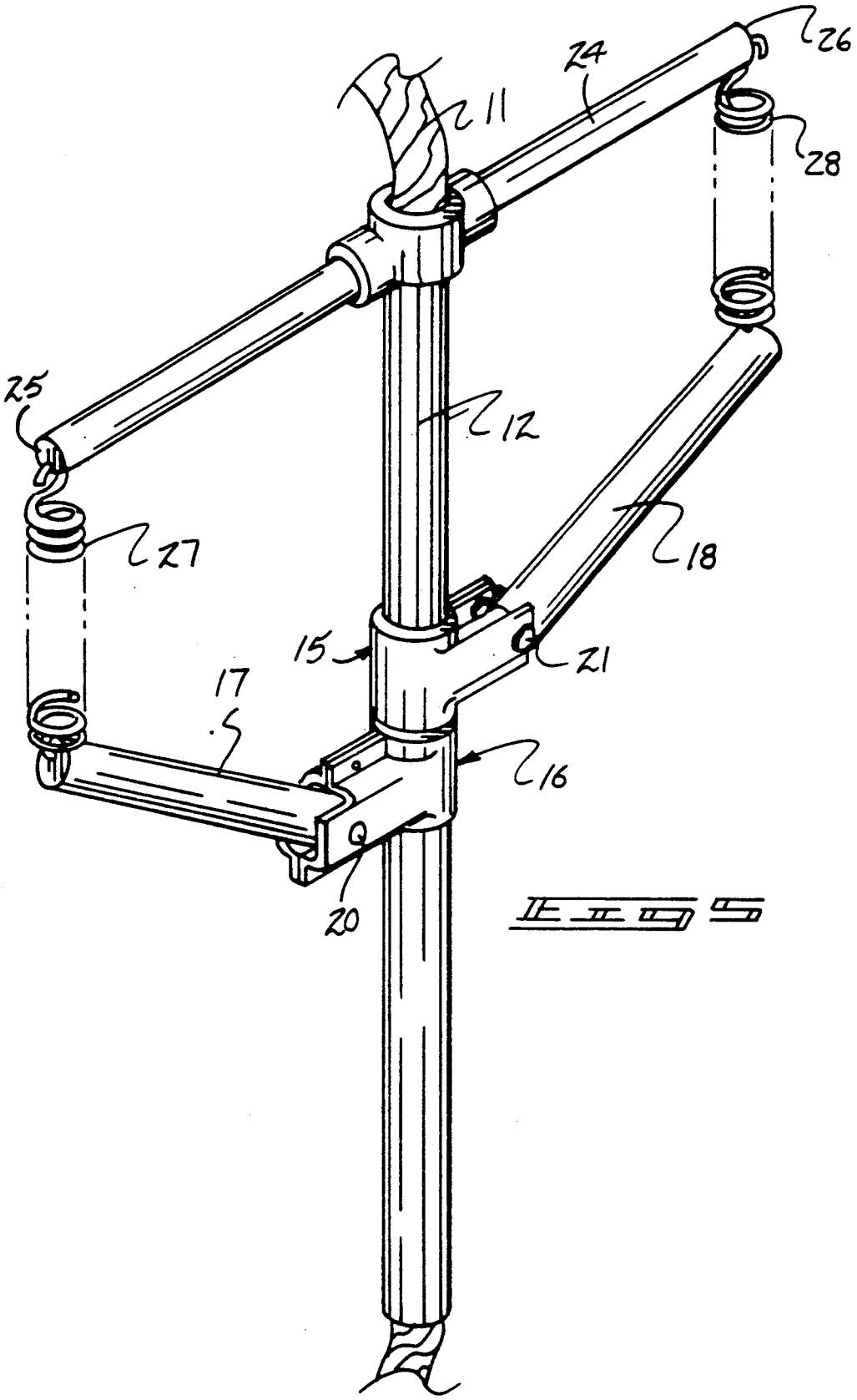
FIG. 5 is an isometric illustration of a modification of the invention.
Figure 6:
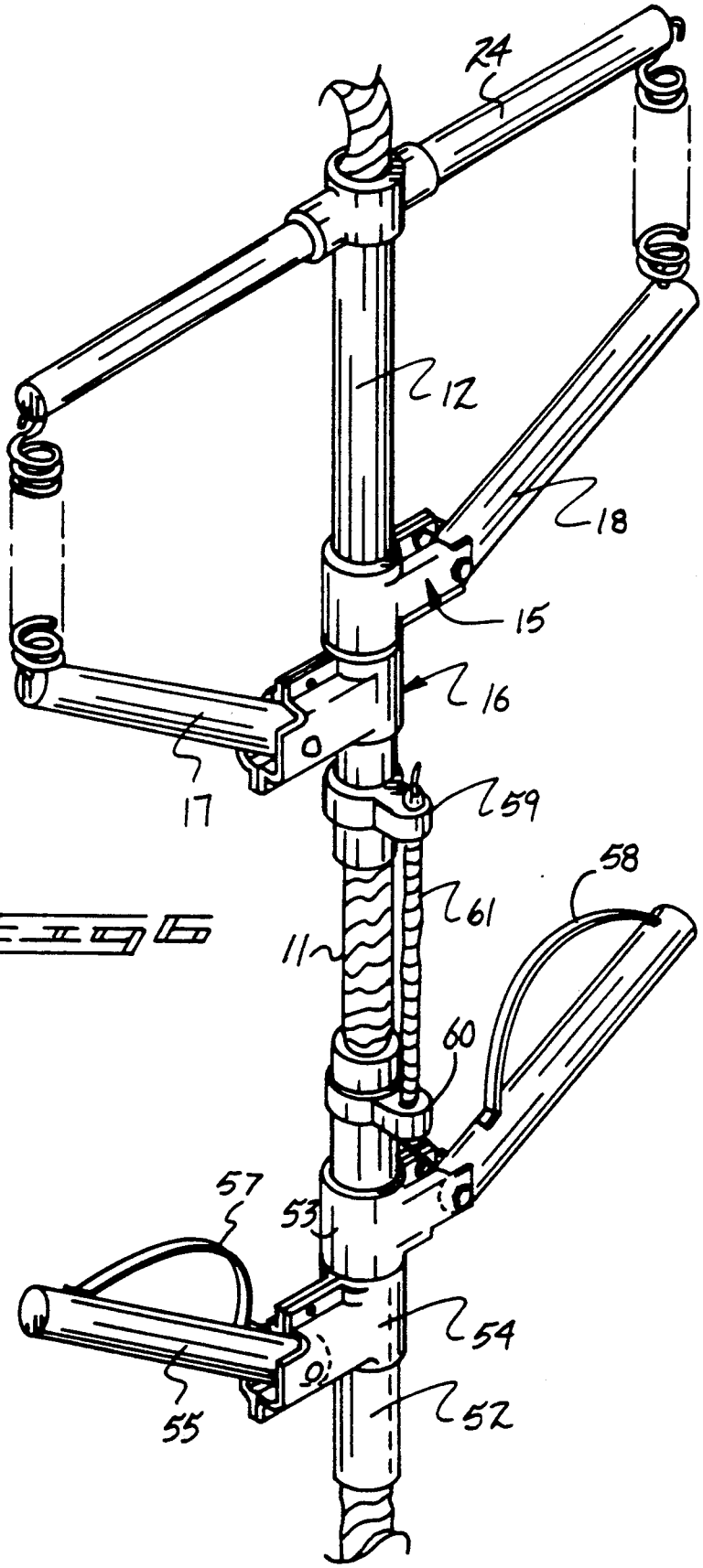
FIG. 6 is an isometric illustration of the invention utilizing seat structure and/or foot support organization.

A modified apparatus is illustrated in FIG. 5 and further includes a support yoke 24 orthogonally mounted to an upper terminal end of the conduit 12, and includes a first end 25 and a second end 26 positioned adjacent and above the outer terminal ends of the first brake rod 17 and the second brake 18 respectively. A first spring 27 is mounted between the first end 25 and the outer terminal end of the first brake rod 17, wherein the second terminal end and the outer terminal end of the second brake rod 18 mounts a second spring therebetween to bias the rods in a raised elevation or orientation relative to the conduit 12 to force an individual to direct the brake rods 17 and 18 into engagement. Further, the modified apparatus includes a second conduit 52 receiving the rope 11 therethrough in a spaced relationship below the conduit 12. Further, seat rest structure is positioned below the first conduit to include the second conduit 52 that mounts a second yoke 60 relative to an upper terminal end of the second conduit 52 cooperative with a conduit yoke 59 mounted adjacent a lower terminal end of the conduit 12, including a tether line 61 joining the conduit yoke 59 and the second conduit yoke 60 together, as it is understood that the conduit yoke 59 and the second conduit yoke 60 are fixedly secured to the respective conduit 12 and second conduit 52. A respective second conduit first and second housing 53 and 54 are mounted in axial adjacency relative to one another, with the first housing 53 mounted to a top portion of the second housing 54, wherein the first and second housings 53 and 54 project diametrically on opposed sides of the second conduit 52 to each pivotally mount respective second conduit first and second rods 55 and 56 by associated pivot axes, wherein inner terminal ends of the first and second rods 55 and 56 are spaced relative to the rope 11, but are provided with respective first and second strap loops 57 and 58 in confrontation with the first and second brake rods 17 and 18 to permit an individual to position their feet within the associated loops and rod or alternatively permit an individual to be seated upon the rods 55 and 56 upon manipulation of the brake rods 17 and 18.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows;

1. A fire escape apparatus, comprising, a rigid coaxially aligned conduit, the conduit slidably receiving a flexible rope member therethrough, and a first housing and a second housing fixedly mounted on diametrically opposed sides of the conduit, including a first conduit slot and a second conduit slot diametrically directed through opposed sides of the conduit within the first housing and the second housing respectively, with a first axle positioned orthogonally through the first housing and adjacent the first slot, and a second axle orthogonally positioned through the second mounting housing adjacent the second slot, and a first brake rod pivotally mounted to the first axle, and a second brake rod pivotally mounted to the second axle, wherein the first brake rod includes a first brake rod lower terminal end and the second brake rod including a second brake rod lower terminal end, with the first brake rod lower terminal end including a first brake pad and the second brake rod lower terminal end including a second pad, with the respective first and second pads projecting respectively through the first and second slots upon downward pivotment of the first and second brake rods relative to the first and second housings, and the first pad and the second pad each include a respective first and second semicyclindrical convex surface directed through the respective first and second slot for engagement with the rope on opposed sides of the rope, and the conduit includes an upper terminal end, the upper terminal end fixedly and orthogonally mounting a support yoke, the support yoke positioned above the first brake rod and the second brake rod, and a first spring mounted between the support yoke and the first brake rod, and a second spring mounted between the support yoke and the second brake rod, wherein the first spring and the second spring are mounted on diametrically opposed sides of the conduit.

2. An apparatus as set forth in claim 1 including a lower conduit slidably receiving the rope therethrough positioned below and in a spaced relationship relative to the lower terminal end of the conduit, the lower conduit including a third housing and a fourth housing fixedly mounted to the lower conduit on diametrically opposed sides of the lower conduit, with the lower conduit including a lower conduit yoke mounted adjacent an upper terminal end of the lower conduit, with the conduit yoke and the lower conduit yoke including a flexible tether line mounted therebetween to secure the conduit to the lower conduit, and the lower conduit including a lower conduit first housing fixedly mounted to the lower conduit, and including a lower conduit second housing fixedly mounted to and below the second conduit first housing, wherein the second conduit first housing and the second conduit second housing project in diametrically opposed orientations relative to the lower conduit, wherein the lower conduit first housing includes a lower conduit first rod pivotally mounted thereto, wherein the lower conduit second housing includes a lower conduit second rod pivotally mounted to the lower conduit second housing, wherein the lower conduit first rod and the lower conduit second rod project in diametrically opposed orientations relative to the lower conduit, and wherein the lower conduit first rod includes a first strap loop mounted to a top surface of the lower conduit first rod and the lower conduit second rod includes a lower conduit second strap loop mounted to a top surface of the lower conduit second rod.

* * * * *